US005678816A

United States Patent [19]

Marschke et al.

[11] Patent Number: 5,678,816

[45] Date of Patent: Oct. 21, 1997

[54] SYSTEM FOR FEEDING SHORT LENGTH SHEETS FOR SLITTING

[75] Inventors: Carl R. Marschke; Andrew J. Ponomarenko; Shayne A. Roberts; Jeffrey J. Willers, all of Phillips, Wis.

[73] Assignee: Marquip, Inc., Phillips, Wis.

[21] Appl. No.: 595,047

[22] Filed: Feb. 1, 1996

[51] Int. Cl.[6] ..... H03M 13/00

[52] U.S. Cl. ..... 271/42; 271/128; 414/796.8; 414/796.6; 414/917

[58] Field of Search ..... 271/42, 128; 414/796.8, 414/796.6, 917

[56] References Cited

U.S. PATENT DOCUMENTS 1,174,739 3/1916 Langston ..... 271/128
3,350,090 10/1967 Larson ..... 271/42

FOREIGN PATENT DOCUMENTS 2402701 8/1974 Germany ..... 414/796.8

*Primary Examiner*—H. Grant Skaggs

*Attorney, Agent, or Firm*—Andrus, Sceales, Starke & Sawall

[57] ABSTRACT

A system for feeding and slitting short length, long width sheets and particularly suitable for solid fiberboard materials, includes a dual acting rake-type sheet feeder, a sheet decurling apparatus, and a multi-head slitter, all of which are interconnected to maintain positive sheet control through the entire system with resultant highly accurate short width slit sheet portions.

9 Claims, 7 Drawing Sheets

FIG. 5
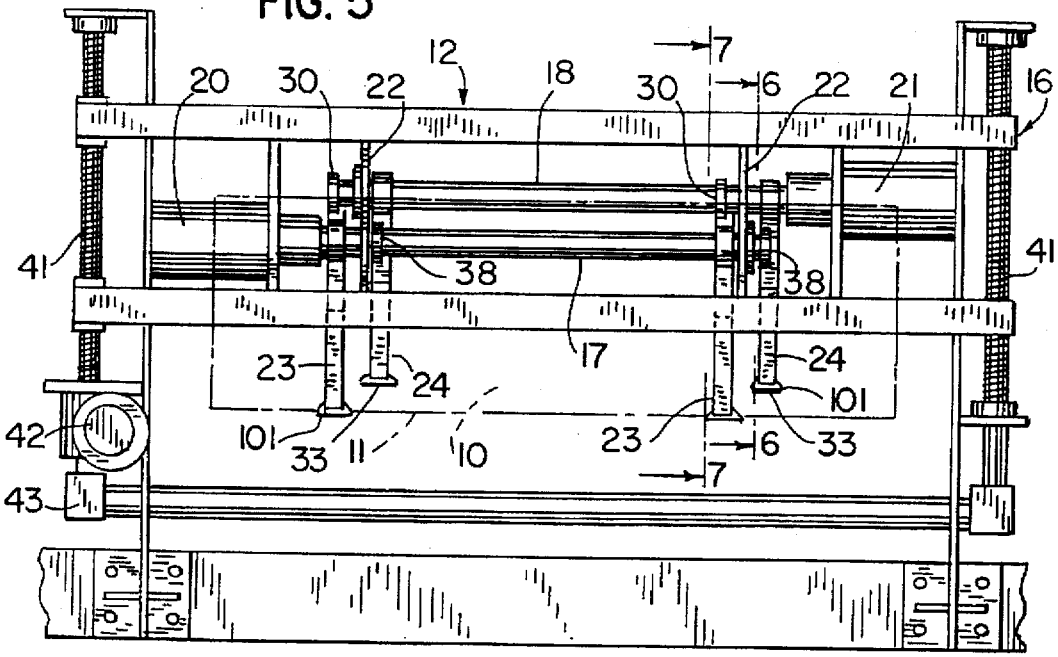
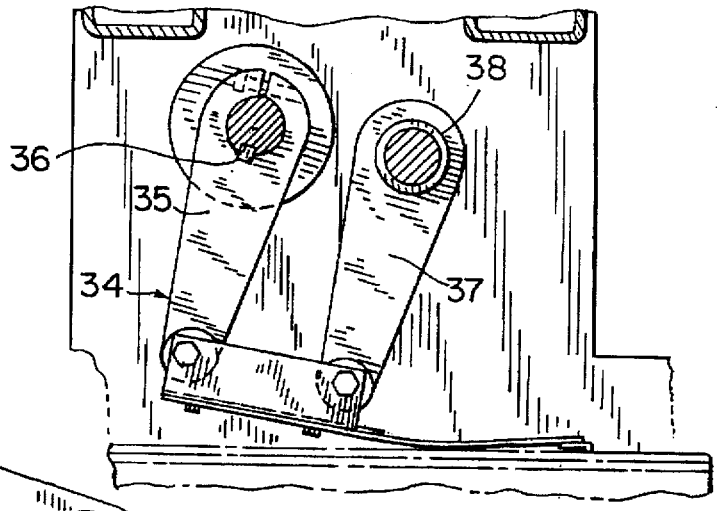
FIG. 6
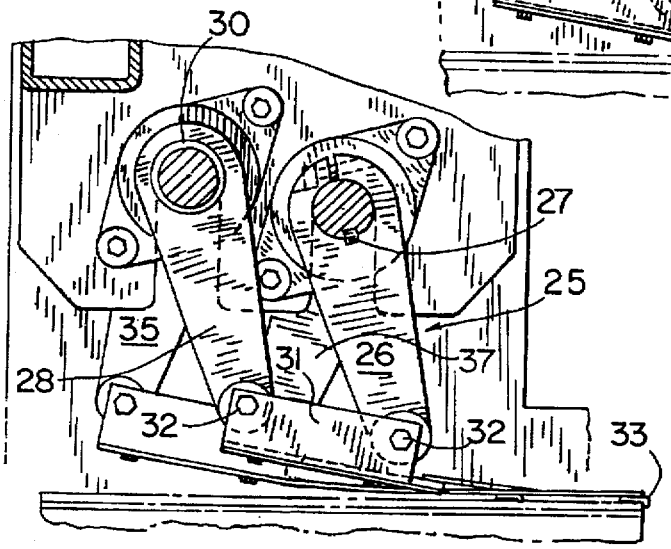
FIG. 7

SYSTEM FOR FEEDING SHORT LENGTH SHEETS FOR SLITTING

BACKGROUND OF THE INVENTION

The present invention pertains to a system for serially delivering closely spaced sheets for slitting and, more particularly, to a system for feeding short length and long width sheets from the top of a vertically ascending stack, through a sheet decurling apparatus, and through a multi-head slitter for slitting the sheet into multiple narrow width sheet portions.

The present invention is adapted to feed sheets from the top of a continuously ascending stack of sheets delivered from the system described in co-pending and commonly assigned patent application entitled "System for Delivering Sheets in Stacks", filed concurrently herewith. The narrow slit sheets exiting the system of the present invention may be delivered to a sheet stacking apparatus of the type described in co-pending commonly assigned U.S. patent application Ser. No. 08/515,305, filed on Aug. 15, 1995, and entitled "Sheet Stacking Apparatus" and now U.S. Pat. No. 5,613,673.

When converting fiberboard sheets having a very short length, in the range of 6–18 inches (about 15–45 cm) and a substantially longer width up to 60 inches (about 152 cm), into a number of narrow width sheet portions by conveying the sheets through a multi-head slitter, a number of sheet handling problems arise. One problem is the maintenance of sheet alignment which is particularly difficult with short length sheets. Another is the ability to provide high rate feeding of the sheets in a reliable manner and at a speed adequate to keep pace with upstream delivery and downstream converting processes. Fiberboard sheets also often are subject to curling in the direction of sheet length (or machine direction) and undesirable curl must be eliminated. Multi-head slitting of long width fiberboard sheets presents a number of difficulties. Recently developed thin blade slitting techniques are unsuitable because solid fiberboard provides little lateral flexibility, resulting in blade jamming when making multiple parallel slits. More conventional rotary shear type cutting results in sheet edge displacement in opposite directions normal to the sheet and causes potentially undesirable compound bending of the sheet portions or outs in a multi-head tool generating a number of laterally adjacent narrow sheet portions. Finally, sheet portion alignment and control becomes increasingly difficult in the slitting operation.

The present invention provides a system which addresses and effectively eliminates all of the foregoing problems in a highly efficient and effective manner. The system includes interconnected sheet feeding, decurling and slitting sections in which the short length, long width incoming sheets are held and continuously controlled into and through the multi-head slitter in a manner which maintains accurate size and tolerance control in the resultant slit sheet sections.

SUMMARY OF THE INVENTION

The system of the present invention is operated in accordance with a method whereby sheets of short length and long width, which are delivered in a continuously ascending stack, are fed and slit in a continuous manner to provide a plurality of narrow width sheet portions. The method includes the steps of (a) raking the sheets individually from the top of the ascending stack by engaging trailing edge of each successive sheet with a rake mechanism having a given feed stroke length; (b) capturing the lead edge of the sheet while the trailing edge is engaged by the rake mechanism by positioning a decurler infeed nip at the downstream end of the feed stroke; (c) conveying the sheet between upper and lower decurling belts running between the infeed nip and a downstream outfeed nip; (d) slitting the sheet into the sheet portions in a multi-blade rotary slitting apparatus positioned less than one sheet length downstream of said outfeed nip; and, (e) nipping the edge of each sheet portion during slitting in slitting nips positioned adjacent each blade and coaxial therewith.

The system of the present invention includes several directly connected and interrelated subassemblies, including a raker apparatus for feeding sheets horizontally from the top of the ascending stack of sheets. The raker comprises a pair of parallel driveshafts mounted above the stack and extending normal to and spaced from one another in the direction of sheet feed, two pairs of sheet feeding rake arms which are suspended from the driveshafts by a linkage mechanism providing alternating reciprocal movement over the top of the stack between an upstream position and a downstream position, the linkage mechanism including a drive arm for each of the rake arms, each of which drive arms has an upper end fixedly attached to one driveshaft and a lower and rotatably attached to the rake arm, and a support arm having an upper end which is rotatably attached to the other driveshaft and a lower end which is rotatably attached to the rake arm. One pair of the rake arms has its drive arms attached to one driveshaft and the other pair has its drive arms attached to the other driveshaft. Means are provided for independently and reversibly driving each driveshaft to cause alternating reciprocal movement of one pair of rake arms with respect to the other, and a rake head is attached to the upstream end of each rake arm such that the rake heads of one commonly attached pair of rake arms, when in the upstream position, engage the upstream edge of the top of the sheet in the stack while the rake heads of the other pair of rake arms are in the downstream position.

Each of the rake arms preferably comprises a flexible resilient member which is mounted to bias the rake head against the surface of the sheet. The apparatus also includes means mounting the apparatus for adjustable positioning over the stack to accommodate sheets of varying length. In the preferred embodiment, the rake arm linkages comprise four bar parallelogram links.

The decurling apparatus removes machine direction curl from moving sheets, particularly paperboard sheets, and includes a series of parallel spaced upper and lower drive belts which are mounted to define parallel planar sheet conveying upper and lower belt runs adapted to receive and convey therebetween the serially fed sheets. A first decurling section includes a first decurling roll rotatably mounted in contact with the backside of one belt run, and a pair of second decurling rolls rotatably mounted in contact with the backside of the other belt run. The axes of said first and second rolls are disposed parallel to one another and the axes of the second pair positioned upstream and downstream of the axis of the first roll with respect to the direction of sheet feed. Means are provided for moving the first roll relatively toward the second rolls and displacing portions of the belt runs therebetween out of the plane of movement to create a first curved sheet path portion opposite the curl in the sheets.

The apparatus preferably includes a second decurling section which is positioned spaced from the first section along the belt runs and has a first roll and a pair of second rolls mounted in contact with the respectively opposite belt runs from the rolls of the first section and operative to create a second curved sheet path portion in a direction opposite the first curve sheet path portion. Preferably, the upper and lower driven belts comprise toothed timing belts with the tooth patterns on the respective backsides of the belts, and the first and second rolls comprise splined shafts having tooth patterns adapted to be drivingly engaged by the teeth of the timing belts. In the preferred embodiment, selected ones of each series of upper and lower driven belts are extended in the upstream direction to form laterally spaced pairs of belts, each pair comprising an upper and a lower belt and the laterally spaced belt pairs positioned to form a sheet infeed nip.

The slitting section of the apparatus of the present invention includes a pair of rotary slitting tools having annular peripheral cutting edges, and tool heads for carrying the slitting tools and mounted for rotation on parallel axes positioned to provide operative engagement between the cutting edges. Each tool head has a mounting hub with a cylindrical peripheral surface coaxial with and positioned axially adjacent the cutting edge of the tool and a nip wheel having a flexible peripheral surface which is coaxial with and positioned axially adjacent the cutting edge of the tool on the side opposite the mounting hub. Means are provided for mounting the tool heads to create a sheet nip between the cylindrical surface of the hub of one tool head and the surface of the nip wheel of the other tool head when the cutting edges are in operative engagement. Preferably, each tool head pair defines a pair of sheet nips on axially opposite sides of the tool.

In another aspect of the invention, a rotary slitting apparatus for cutting solid fiberboard sheets comprises a plurality of pairs of annular slitting tools which tools have beveled peripheral shear-type cutting edges that are adapted to overlap in operative cutting engagement and to displace the adjacent edges of the slit sheet in opposite directions normal to the plane of the sheet. Tool heads are provided for carrying the slitting tools, the heads for one of the tools of each pair mounted for rotation on one axis and the tool heads for the other of the tools of each pair mounted for rotation on another axis parallel to the one axis and positioned to provide operative engagement between the cutting edges. Each tool head has a hub that defines a cylindrical annular surface coaxial with and axially adjacent the tool cutting edge, and a nip wheel that has a flexible annular surface which is coaxial with and axially adjacent the cutting tool on the side thereof axially opposite the hub. Means are provided to mount the tool heads to create a pair of sheet engaging nips on axially opposite sides of each operatively engaged tool pair, each of which nips is formed between the annular surface of the hub of one head and the flexible annular surface of the other head.

In the preferred embodiment, the diameter of the annular hub surface is less than the diameter of the tool cutting edge, and the diameter of the flexible annular surface is greater than the diameter of the cutting edge. The nip wheel for each tool head is preferably mounted adjacent the beveled face of the cutting tool. In the preferred assembly, axially adjacent tool pairs are mounted with the nip wheels for the sheet portion being slit by said adjacent tool pairs on the same side of the sheet, so that the opposite slit edges of the sheet portion are displaced in the same direction normal to the plane of the sheet.

BRIEF DESCRIPTION OF THE DRAWINGS

FIG. 5 is a top plan view of the sheet feeding section including the raking apparatus of the present invention.

FIG. 6 is an enlarged vertical section taken on line 6—6 of FIG. 5.

FIG. 7 is an enlarged vertical section taken on line 7—7 of FIG. 5.

DETAILED DESCRIPTION OF THE PREFERRED EMBODIMENTS

Figure 1:
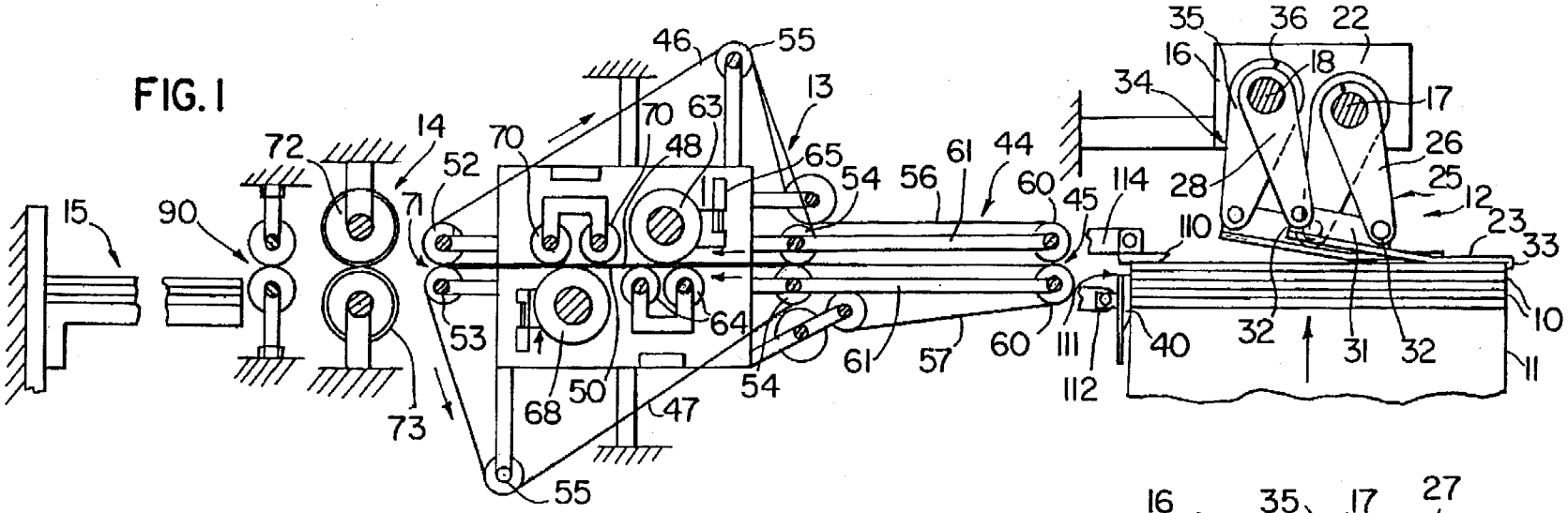
FIGS. 1–4 are schematic side elevation views of the overall system of the present invention, including sheet feeding, decurling, and slitting sections.

Referring initially to FIGS. 1–5, the system of the present invention is adapted to receive short length, long width sheets 10 from a continuously ascending stack 11 and to feed the sheets from the top thereof with a sheet feeder 12 into and through a decurling apparatus 13, and into a multi-blade rotary slitting apparatus 14 where the long width sheet is cut into a plurality of narrow width sheet portions. To assure accurate control and alignment of the sheets and to accommodate high speed sheet feeding, continuous direct sheet engagement is provided throughout processing into a downstream stacker 15 or other suitable device for handling multiple stacks of the narrow width sheet portions. The system is particularly adapted to handle solid fiberboard sheets whose length may range from 6–18 inches (about 15–45 cm) and having a width of 40–60 inches (about 102–152 cm) or more. The top plan view of FIG. 5 shows the general shape of the top sheet 10 in the ascending stack 11.

The sheet feeding apparatus 12 is mounted on a supporting frame 16 directly over the top of the ascending stack 11. The feeder includes a pair of parallel upstream and downstream driveshafts 17 and 18, respectively, each of which is directly driven by its own electric servomotor 20 and 21, respectively. Each of the driveshafts is rotatably supported for rotation on a pair of laterally spaced mounting brackets 22 which are, in turn, attached to the supporting frame 16. The driveshafts are adapted to support and drive two pairs of rake arms 23 and 24, the rake arms of each pair operating together and directly opposite or 180° out of phase with the other pair. Rake arm pair 23 is driven by the upstream driveshaft 17 and motor 20, while the rake arm pair 24 is driven by the downstream driveshaft 18 and associated motor 21.

Referring also to FIGS. 6 and 7, each rake arm 23 or 24 is suspended from both driveshafts 17 and 18 by a four bar linkage mechanism in a manner to provide alternating reciprocal movement of the pairs 23 and 24 over the top of the stack between an upstream position and a downstream position to feed the sheets in a generally horizontal direction one at a time from the top of the stack. Referring specifically to FIG. 7, a first linkage 25 will be initially described with respect to rake arm pair 23 which is shown in the upstream position and only one of which pair is visible because of their lateral alignment. The first four bar linkage 25 includes an upstream drive arm 26 which is fixed to the upstream driveshaft 17 for rotation therewith, as by a keyed connected 27. A downstream support arm 28 is rotatably attached at its upper end to the downstream driveshaft 18 as with a bearing 30. The lower ends of the drive arm 26 and support arm 28 are rotatably attached to the upstream and downstream ends of a rake arm bracket 31 with suitable pinned connections 32. The rake arm 23 extends in the upstream direction from the rake arm bracket 31 and is made of a thin flexible and resilient steel strip positioned to be held in downwardly biased contact with the top sheet 10 on the ascending stack 11. The free upstream end of the rake arm includes an integral rake head 33 which is adapted, when the rake arm is in the upstream most position of its stroke, to engage the upstream edge of the top sheet in the stack. When the upstream drive motor 20 is driven to rotate the upstream driveshaft 17 in a clockwise direction from the FIG. 7 position, also shown in FIG. 1, the linkages 25 carry the rake arms 23 and engaged sheet 10 in a horizontal direction to its downstream position shown in FIG. 2.

The above clockwise rotation of upstream driveshaft 17 is limited to a relatively small circular arc of approximately 27° which translates into a rake arm feed stroke of about 3½ inches (about 9 cm). Simultaneously, the downstream driveshaft 18 is driven in a counterclockwise direction through the same circular arc to rotate a pair of second four bar linkages 34, carrying rake arm pair 18 from their downstream position to the upstream position. The opposed rotational motion of the second linkage 34 with respect to the first linkage 25 requires a reverse orientation of the linkage members. Thus, the second linkage 34 includes a downstream drive arm 35 which is fixedly attached to the downstream drive shaft 18 with a keyed connection 36. The linkage also includes an upstream support arm 37 rotatably attached to the upstream driveshaft 17 with a bearing 38. The lower ends of the drive arm 35 and support arm 37 are rotatably attached to a rake arm bracket 31 with pinned connections 32. Each of the rake arms 24 is otherwise identical to the rake arms 23 of the other pair and both include identical rake heads 33 on their free upstream ends.

The oppositely driven four bar linkages 25 and 34 are identical except for the reverse mountings of their respective drive arms and support arms and, as a result, both rake arm pairs 23 and 24 exhibit the same motion and follow identical paths as viewed in the cross machine direction of FIGS. 1–4. The alternating dual reciprocating rake arm pairs allow the feeder to operate at twice the feed speed of a system using only a single motor-driveshaft.

The sheet feeder 12 is adapted to feed sheets of a substantially shorter length than those shown in the drawings without changing the feed stroke and without changing the position of the downstream backstop 40 against which the ascending stack 11 is guided. Therefore, the sheet feeder must be adjustable in the horizontal direction of sheet feed and, in particular, to be moved in a downstream direction from the position shown in the drawings. As shown in FIG. 5, the supporting frame 16 is mounted for adjustment on a pair of parallel lead screws 41 mounted on opposite sides of the feeder. The lead screws are driven by an electric motor 42 mounted adjacent the end of one lead screw. The drive mechanism includes a right angle transfer to provide synchronous drive to the other lead screw. As the sheet feeder supporting frame 16 is moved in the downstream direction to accommodate shorter sheets, space must be made for the rake arm linkages 25 and 34 in the downstream decurling apparatus 13 as will be described hereinafter.

FIGS. 8–11 show details of the rake arm 23 and rake head 33 used therewith, it being understood that the rake arms 23 forming one operative pair are identical to the rake arms 24 forming the other pair. All four rake heads 33 are also identical. As previously indicated, each rake arm 23 is made of a thin strip of spring steel and is attached to its respective rake arm bracket 31 in a manner which biases the rake arm downwardly into contact with the top sheet 10 of the stack 11. The rake head 33 has the shape, in the plan views of FIGS. 8 and 10, of a truncated parallelogram. The rake head is attached to the lower face of the rake arm with a pair of machine screws 100. The free edge of the rake head 33 includes a downwardly depending claw 101 which includes a sheet-engaging face 102. The face 102 has a depth (measured perpendicular to the surface of the head) slightly smaller than thickness of the sheet 10 to be fed.

Figure 10:
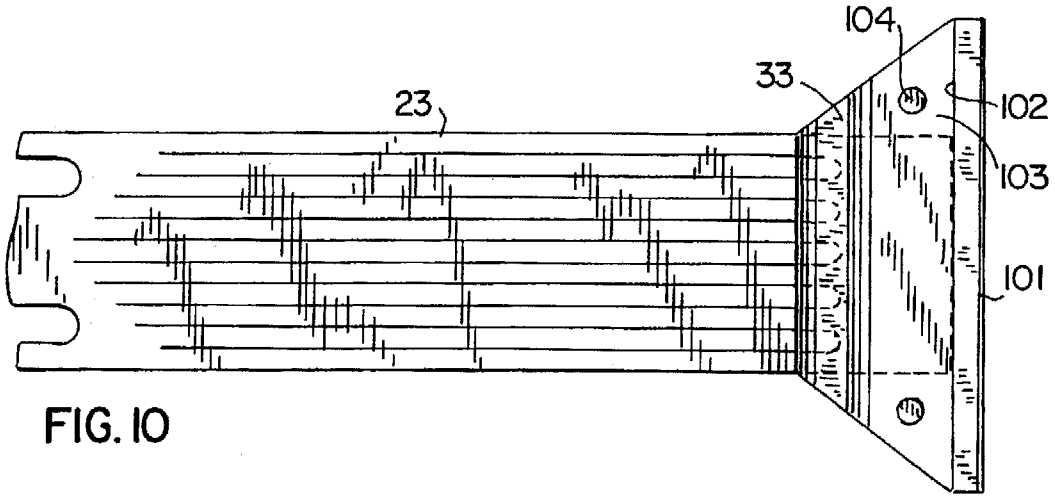
FIG. 10 is a bottom plan view similar to FIG. 8 showing the attachment of a removable shim to the rake head.
Figure 9:
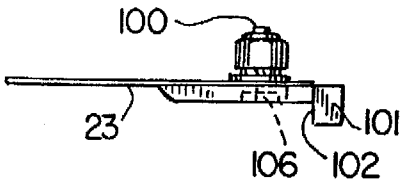
FIG. 9 is a side view of the rake arm and head shown in FIG. 8.
Figure 11:
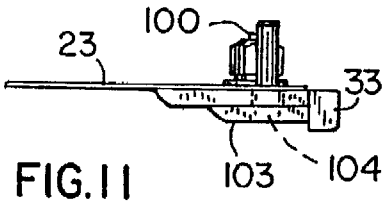
FIG. 11 is a side view of the rake arm and head shown in FIG. 10.

To easily accommodate changes in the thickness (or caliper) of sheets being handled in the disclosed apparatus, a demountable shim 103 is utilized, as shown in FIGS. 10 and 11. The shim 103 is made of steel and includes a pair of locating pins 104 extending perpendicularly from its inner flat face. The shim has a shape, in plan, of a parallelogram of generally the same size as the rake head 33 and the latter is provided with a pair of spaced through holes 105 for receipt of the locating pins 104. In addition, the face of the rake head 33 is provided with a blind hole 107 into which a magnet 106 is inserted and held with a press fit. The shim 103 may be of any desired thickness and, when attached to the rake head and held in place by the magnet 106, reduces the depth of the sheet-engaging face 102 to accommodate sheets of a different thickness.

The rake arm 23 is also designed to accommodate irregularities in the sheets 10 comprising the stack 11, which irregularities may result in an uneven sheet surface and edge engaged by the claws 101 of the rake heads. Sheet irregularities in the cross machine direction may be severe enough so that full engagement by a normally horizontally disposed sheet-engaging face 102 is not assured and, as a result, sheets may be misfed or damaged. To provide torsional flexibility in the cross machine direction, while retaining essentially full stiffness of the flexible rake arm 23 in the machine direction, a portion of each rake arm near the attachment end for the rake head is provided with a series of narrow, parallel through slits 108. Each of the slits 108 extends from a downstream end (with respect to sheet movement) to an upstream end where it is joined with an adjacent slit to form a series of parallel spaced tongues 109. The slits 108 are preferably cut with a laser cutting tool to maintain a very narrow thickness, in the range for example of 0.007 inch (0.18 mm). The net effect of the free cutout tongues 109 is to reduce significantly the resistance of the rake arm 23 to lateral (cross machine direction) flexing, thereby allowing the claw 101 to accommodate cross machine direction irregularities in the sheets or the upper stack surface. This helps assure that the sheet-engaging face 102 of the claw will make full width engaging contact with the upstream edge of each sheet, as shown in FIG. 7.

Referring again to FIGS. 1–4, the backstop 40 also functions as a gate to allow only a single sheet 10 at a time to be raked from the top of the ascending stack and fed into the downstream decurling apparatus 13. The backstop 40 operates in conjunction with a shoe 110 positioned above the backstop to define a gate opening 111 having a vertical dimension slightly greater than the sheet caliper or thickness, but less than twice the caliper. The backstop 40 is attached to one end of a lower pivot arm 112, the opposite or downstream end of which is pivotally attached to a lower pivot shaft 113. Similarly, the shoe 110 is pivotally attached to the upstream end of an upper pivot arm 114, the downstream end of which is pivotally attached to an upper pivot shaft 115. Further, the upper pivot arm 114 and attached shoe 110 are downwardly biased to maintain the shoe in contact with the top of the stack 11. Finally, the pivot arms 112 and 114 are mechanically joined with a vertical link 116 to move vertically together, thereby maintaining the gate opening 111 and simultaneously to accommodate any fluctuations in the position of the top of the ascending stack. The mechanical link between the pivot arms 112 and 114 is preferably adjustable to change the size of the gate opening 111 as desired.

Figure 2:
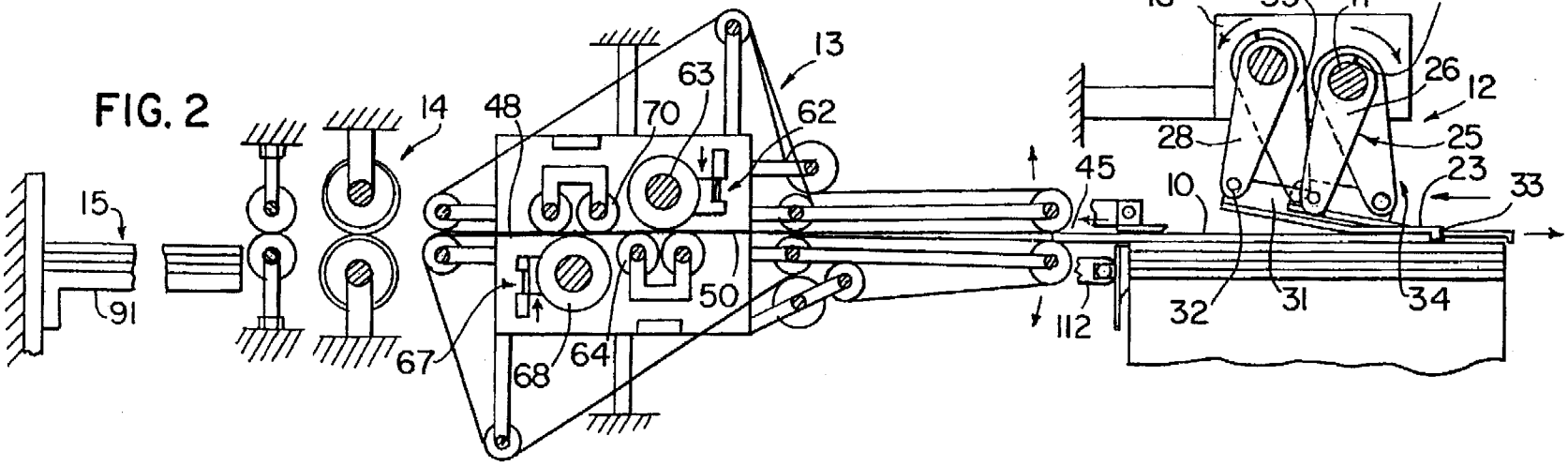

The decurling apparatus includes an upstream nip section 44 which defines an infeed nip 45 spaced from the sheet feeder to receive and nip the lead edge of a sheet just as the pair of rake arms 23 or 24 which are feeding the sheet reach the downstream end of their feed stroke, as best shown in FIG. 2. If a stack of shorter sheets is delivered to the feeder, the position is adjusted by moving the frame 16 in a downstream direction so that the rake arms engage the upstream sheet edge at the upstream end of the feed stroke, yet deliver the shorter sheets directly into the infeed nip 45 as just described.

Figure 12:
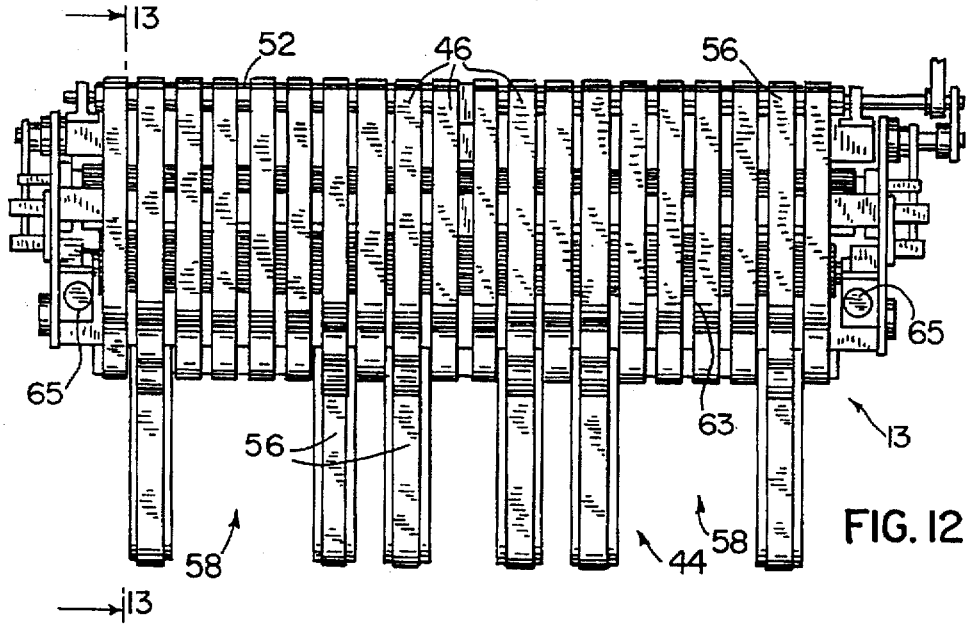
FIG. 12 is a top plan view of the decurling section of the system shown in FIGS. 1–4.
Figure 13:
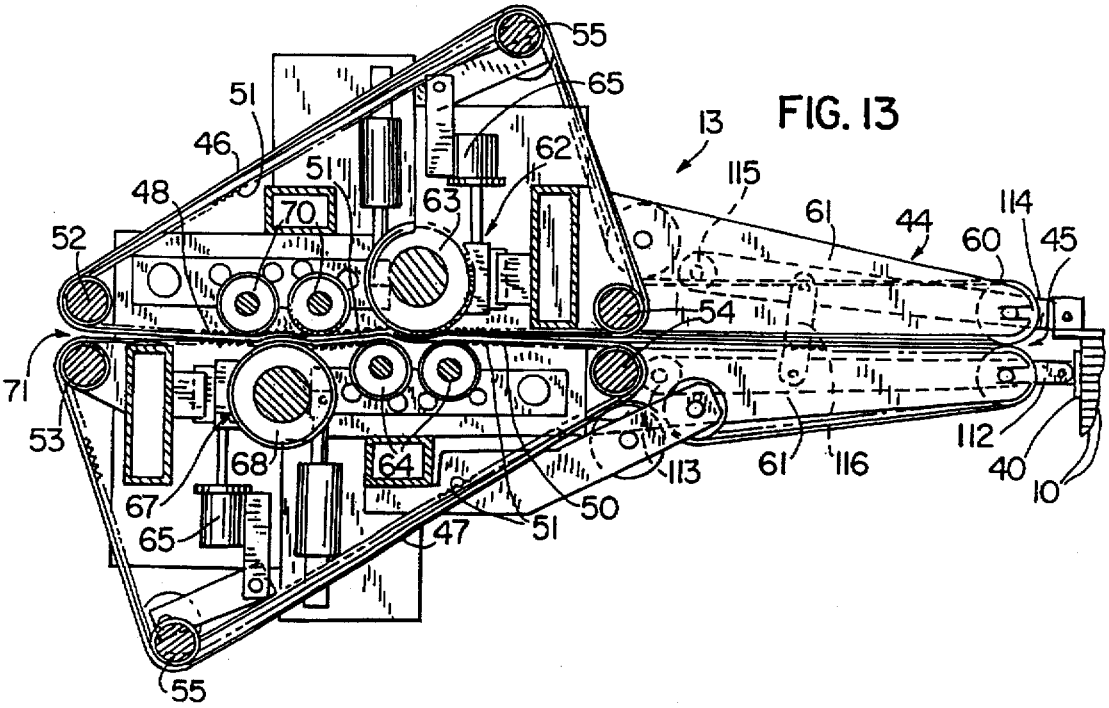
FIG. 13 is an enlarged vertical section taken on line 13—13 of FIG. 8.
Figure 14:
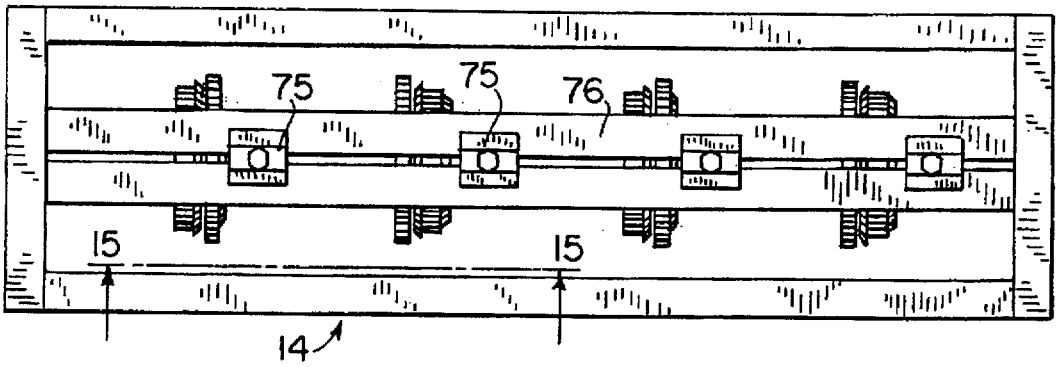
FIG. 14 is a top plan view of the slitting section of the system shown in FIGS. 1–4.

Referring also to FIGS. 12 and 13, the decurling apparatus 13 is adapted to remove machine direction curl from the sheets, which curl may be characterized by either upward or downward bowing of the lead and trailing sheet edges. A series of parallel and closely spaced upper driven belts 46 and corresponding oppositely facing lower driven belts 47 are mounted and operated to define parallel planar upper and lower belt runs 48 and 50 which are adapted to receive and convey therebetween the serially fed sheets 10 from the sheet feeder 12. All of the belts 46 and 47 are toothed timing belts having the driving tooth patterns 51 on the respective backside of the belts and the smooth outer belt faces running in contact with the sheets moving therethrough. The upper and lower belts 46 and 47 are driven together by respective upper and lower splined drive rolls 52 and 53. The upper and lower belts 46 and 47 are also entrained around upper and lower tension rollers 55 and most of the belts also travel around upper and lower idler rollers 54. However, selected vertically aligned pairs of upper and lower belts 56 and 57 are extended in the upstream direction to provide the nip section 44 including the infeed nip 45. In particular, the pairs of extended belts 56 and 57 are selected to create gaps 58 in the nip section 44 to accommodate the rake arm linkages 25 and 34 when the sheet feeder 12 is adjusted in the downstream direction to handle shorter length sheets, as shown in phantom in FIG. 1. Nip idler rollers 60 which carry the extended belts 56 and 57 and form therewith the infeed nip 45 are individually mounted on frame extensions 61.

The decurling apparatus is enclosed substantially within the upper and lower belt sections 46 and 47 downstream of the nip section 44. A first or upstream decurling section 62 includes an upper first decurling roll 63 which is rotatably mounted in contact with the backside of the upper belt run 48. The first decurling roll 63 comprises a splined shaft formed with a toothed pattern adapted to be engaged and driven by the horizontal runs of the upper belts 46. A pair of second decurling rolls 64 are rotatably mounted in contact with the backside of the lower belt run 50 and positioned with their axes parallel to the axis of the first decurling roll 63. Further, the second decurling rolls are positioned with their axes respectively upstream and downstream of the axis of the first decurling roll in the machine direction (direction of sheet feed). Thus, the axis of the upper first decurling roll 63 lies in a vertical plane between the axes of the lower second decurling rolls 64. The first decurling roll 63 is vertically adjustable for movement toward and away from the second decurling rolls 64 on a suitable adjustment mechanism 65. Relative movement of the first decurling roll toward the second decurling rolls causes displacement of portions of the belt runs 48 and 50 out of the normal plane of movement and creates a curved sheet path portion 66, as shown schematically in FIG. 3. The first decurling section 62 creates a curved sheet path portion tending to cause an upward bowing of the lead and trailing edges of the sheet, thereby removing a downward curl in the respective edges of the sheet passing therethrough.

Figure 3:
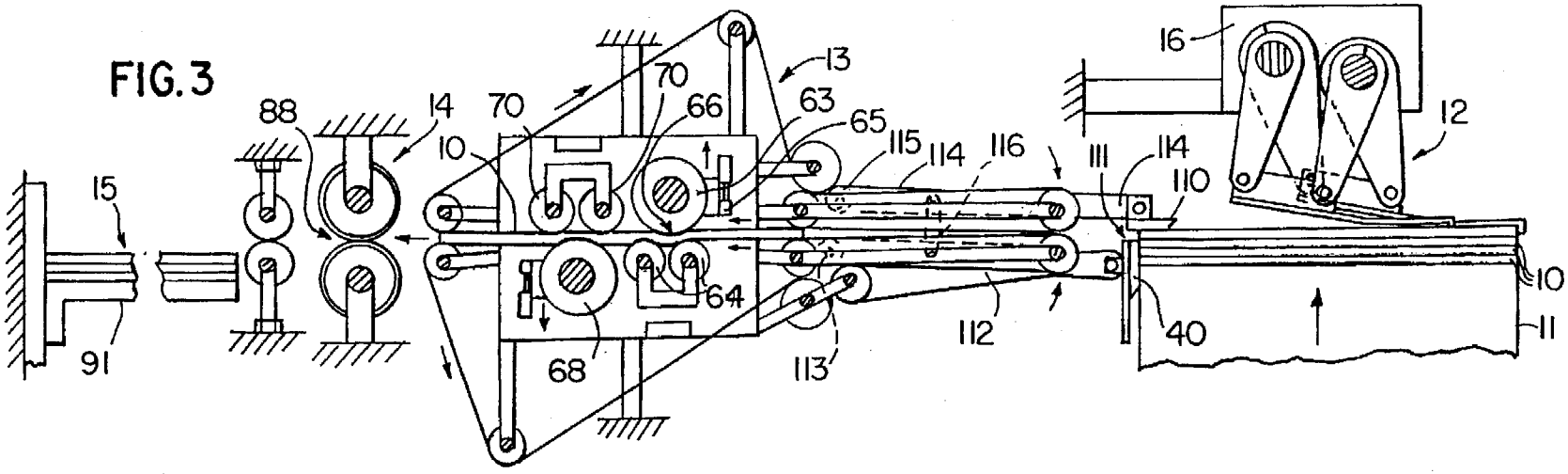
Figure 4:
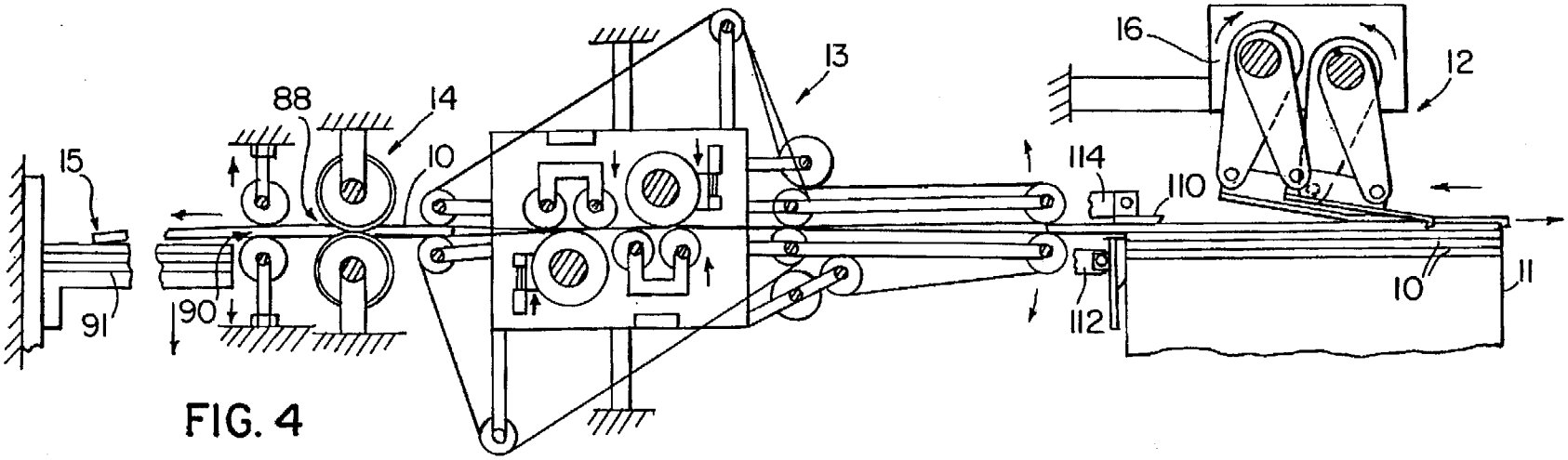
Figure 8:
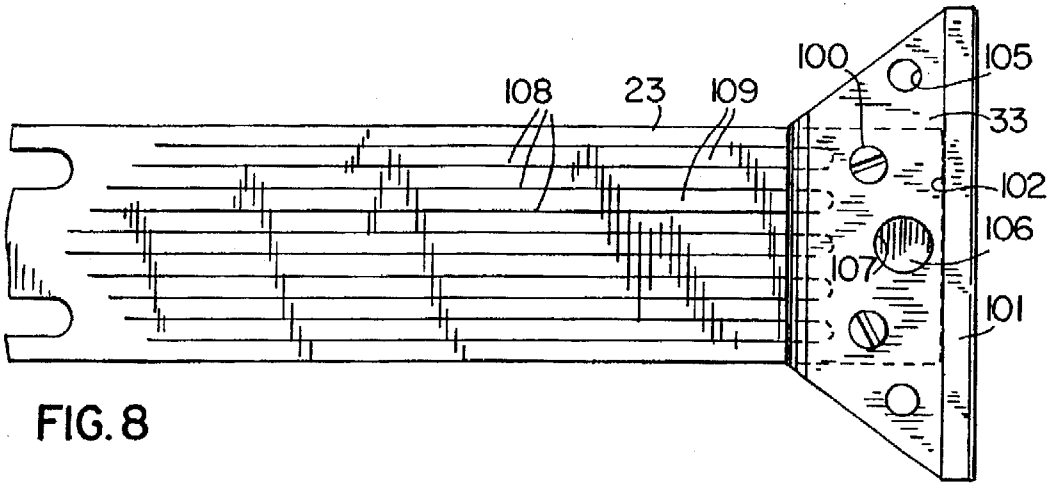
FIG. 8 is an enlarged bottom plan view of a portion of a rake arm and attached rake head.

An opposite or upward curl in the edges of the incoming sheets is removed in a second decurling section 67 which is constructed and operates identically with the first decurling section 62, except for an inversion of the component parts. Thus, the second decurling section includes a lower first decurling roll 68 and a pair of cooperating upper second decurling rolls 70. The lower first decurling roll 68 of the second section 67 is vertically adjustable with an adjustment mechanism 65 identical to that used to adjust decurling roll 63. Although the schematic representation of FIG. 3 shows both decurling sections in operation, typically only one section is used at a time because, if sheets are bowed and require decurling, they are typically all bowed in the same direction.

Figure 18:
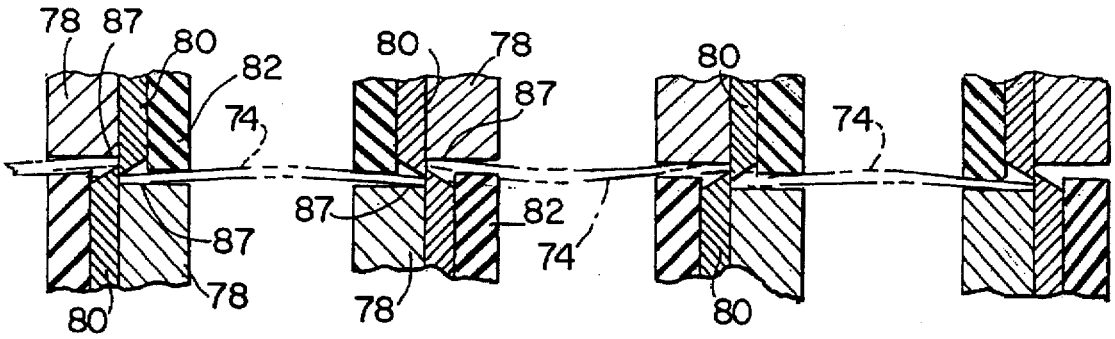
FIG. 18 is a schematic view of the preferred arrangement of the multiple slitting tool pairs of the apparatus of the present invention viewed in the direction of sheet movement therethrough.

The upper and lower drive rolls 52 and 53 with the belts 46 and 47 operating around them define the exist nip 71 from the decurling apparatus 13 and the transition into the downstream slitting apparatus 14. The slitting apparatus includes multiple pairs of upper and lower slitting heads 72 and 73, respectively, which are adapted to slit the incoming sheet 10 longitudinally to provide a number of narrow width sheet portions 74 as shown in FIG. 18 and to be discussed in more detail hereinafter. When slitting solid fiberboard sheets, or even a continuous web of solid fiberboard, into a plurality of narrow sheet portions 74 or outs, several significant problems must be addressed. Dense solid fiberboard cannot be compressed to any significant extent. Therefore, rotary slitting utilizing a thin sheet or web penetrating slitting blade is unsatisfactory where two or more longitudinal slits are being made because the solid fiberboard material simply will not give sufficiently in the cross machine direction to provide space for the multiple slitting blade widths. The problem, of course, becomes worst as the number of slits or outs increases. Thus, slitting a sheet or web of fiberboard into multiple sheet portions 74 or outs preferably utilizes shear-type slitting tools of the type described herein.

Each slitting head 72 or 73 is rotatably mounted on a tool carriage 75 which is adjustably supported on a tool supporting frame 76 to adjust tool position in the cross machine direction. The tool carriage includes a rotatable spindle 77 to which the slitting head assembly is attached. The spindle includes a stub shaft portion 69 rotatably supported in a bearing 89 on the tool carriage and an integral mounting flange 93 and tool-supporting hub 94. The spindle has a hexagonal through bore 95 for receipt of a common hex driveshaft 96 in a manner well known in the art. The slitting head assembly 72 or 73 may be attached to the spindle in either of two orientations, but with respect to each upper and lower slitting head pair, each assembly is attached in the same manner but to oppositely facing spindles 77. Thus, referring to FIG. 15, the upper and lower pair of slitting heads 72 and 73 on the left side are mounted to their respective spindles 77 in one orientation, while the corresponding upper and lower slitting heads 72 and 73 of the right hand pair are mounted to their respective spindles in an oppositely facing manner, all for the reason to be described hereinafter. Referring first to the right hand tool pair, each slitting head includes a steel mounting hub 78 which is slid onto the supporting hub 94 of the spindle and against the face of the mounting flange 93, followed by an annular beveled-edge slitting tool 80 which is bolted directly to the adjacent face of the mounting hub, and a roller hub 81 rotatably supporting a relatively soft rubber nip wheel 82. The entire assembly is bolted to the mounting flange 93 of the spindle 77 and held in place by an outer retaining ring 83 and mounting bolts 79. Thus, the assembled slitting head 72 or 73 is rotatable as an assembly with the spindle 77, and with the rubber nip wheel 82 being independently rotatable on its roller hub 81. The annular slitting tool 80 is of the well known shear-type including a beveled edge face 84 which, with an opposite generally flat tool face 85, defines an annular slitting edge 86. The slitting tools 80 of the upper and lower heads 72 and 73 are mounted such that there face portions 85 overlap slightly to provide the characteristic shear cut of a web or sheet passing through the slitting nip. As the sheet is being slit, and referring again to FIG. 18, the adjacent edges 87 of adjacent sheet portions 74 are displaced in opposite vertical directions generally normal to the plane of the sheet. However, there is little or no lateral displacement of the substantially incompressible solid fiberboard and, therefore, no tendency for the slitting tools to jam as would be likely if rotary web-penetrating slitting blades were utilized.

The maintenance of accurate slit alignment and, therefore, the dimensional accuracy of the sheet portion widths is also important, but difficult to maintain in a multi-head slitting operation, especially when handling relatively dense solid fiberboard. The slitting of solid fiberboard, particularly into relatively narrow width sheet portions, also raises the problem of board distortion because of the inherent displacement of the board edges when shear cutting tools are utilized. The difficulty in maintaining accurate sheet edge alignment and sheet portion width dimensional accuracy is exacerbated when processing short length sheets. These problems are resolved with the unique slitting head construction described above and the manner in which the slitting heads are mounted and oriented.

Figure 16:
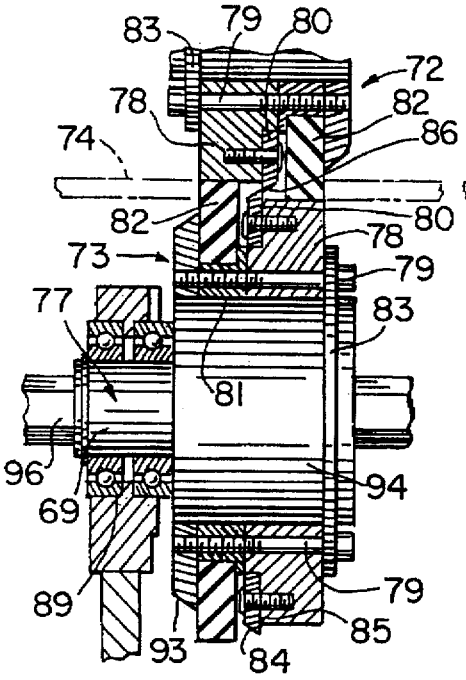
FIG. 16 is an enlarged partial section of one of the pairs of tool heads shown in FIG. 15.
Figure 17:
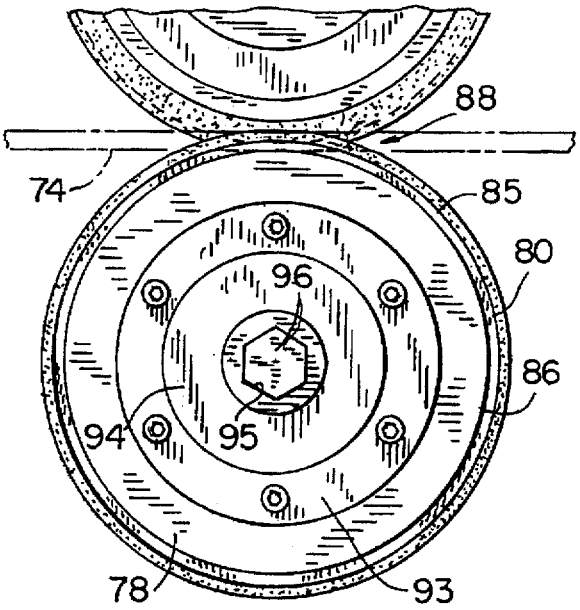
FIG. 17 is an end elevation of the tool head pair shown in FIG. 16.

Referring again to FIG. 11, the tool carriages 75 for each pair of upper and lower slitting head assemblies 72 and 73 are mounted in oppositely facing orientation such that the flat face portions 85 of the annular slitting tools 80 can be brought into engaging face-to-face relationship. When in that slitting position, with the cutting edges in operative engagement, the nip wheel 82 of one slitting head assembly engages the mounting hub 78 of the other assembly such that a pair of sheet edge nips 88 is provided on axially opposite sides of the operatively engaged tool pair 80. The sheet edge-engaging nips 88 capture the leading edge of the sheet 10 while it is still under the control of the exit nip 71 of the upstream decurling apparatus 13 and maintain control of the sheet through the entire slitting operation, and until the resultant slit sheet portions 74 are captured in a series of laterally aligned downstream nips 90, as shown in FIGS. 1–4. Referring also to FIG. 16, the diameter of the flexible nip wheel 82 is greater than the diameter of the annular slitting edge 80, whereas the diameter of the mounting hub 78 is smaller than the slitting edge diameter. Further, in either arrangement of the slitting head assemblies 72 and 73, the rubber nip wheel is always positioned directly adjacent the beveled edge face 84 of the slitting tool. The result is a sheet edge-engaging nip 88 located in an offset position with respect to the slitting tool edges 86 in the direction in which the sheet edge is displaced as it is cut. The nip 88 performs its function effectively and without any significant distortion of the sheet portions.

Figure 15:
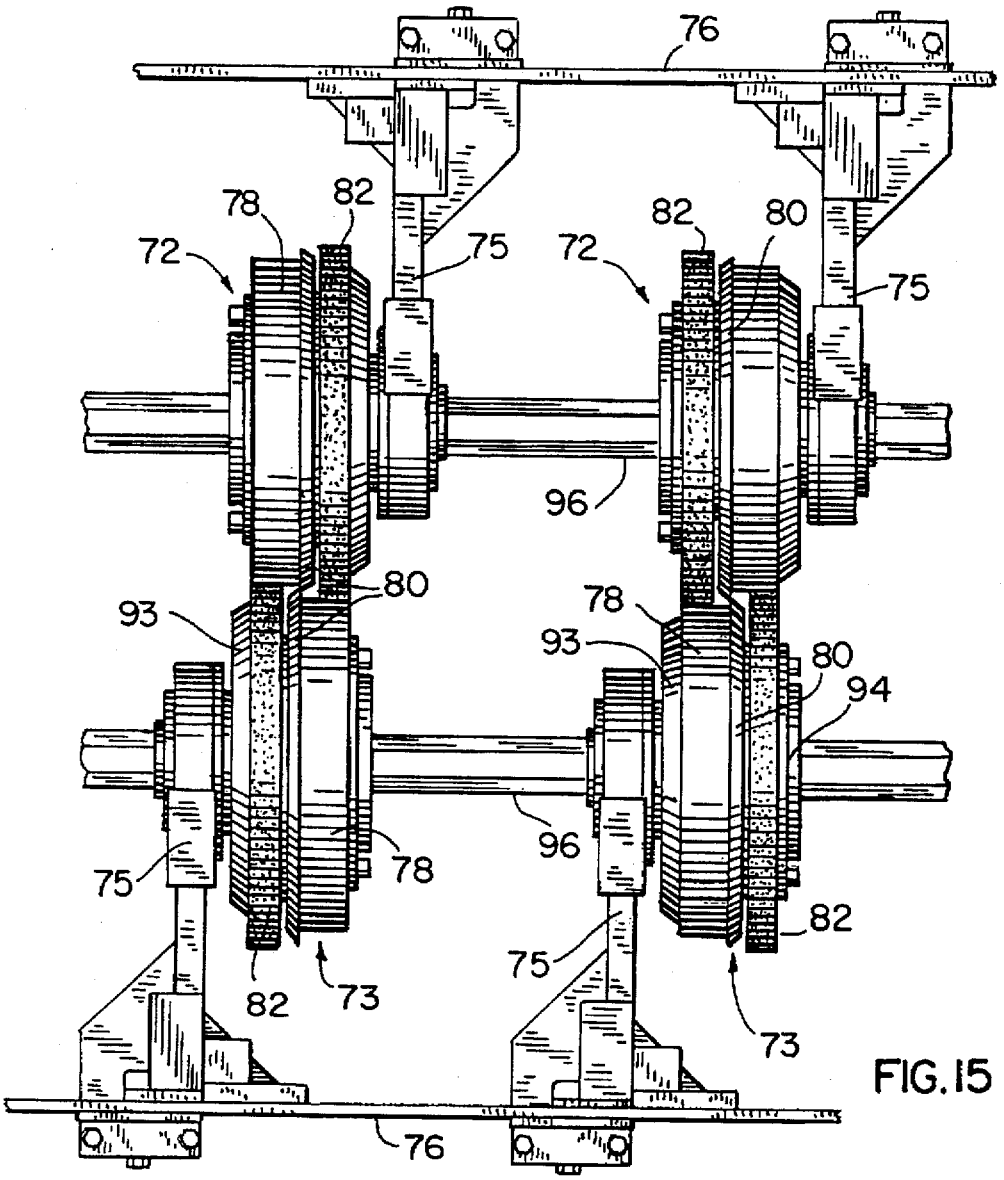
FIG. 15 is an enlarged partial vertical section taken on line 15—15 of FIG. 14.

In FIG. 15, as indicated previously, the pair of upper and lower slitting head assemblies 72 and 73 on the left-hand side are attached to their respective spindles 77 in a manner opposite the slitting head assemblies of the right-hand pair. In particular and referring also to FIG. 16, in each left-hand assembly, the nip wheel 82 and its roller hub 81 are placed on the supporting hub 94 of the spindle first, followed by the annular slitting tool 80, mounting hub 78, and retaining ring 83, all secured to the spindle flange 93 by mounting bolts 79 in a manner previously described. The resulting arrangement of laterally adjacent cutting tool pairs positions the nip wheels for each sheet portion 74 on the same side of the sheet. In this manner, the opposite slit edges of each sheet portion are displaced in the same vertical direction normal to the plane of the sheet, as best seen in FIG. 18. The result is a minimization of sheet distortion. At most, the slit sheet portions 74 are subjected to a slight bowing, but without the special reverse orientation of laterally adjacent tool pairs, undesirable compound curvature of the sheet portions could occur. As may be clearly seen in FIG. 18, with respect to the full sheet portions 74 shown, and taken from left to right across the figure, the opposite slit edges of the first sheet portion are both displaced downwardly, the opposite slit edges of the second sheet portion are both displaced upwardly, and the opposite slit edges of the third slit portion are again both displaced downwardly.

The slit sheet portions 74 leaving the integral sheet nips 88 in the slitting apparatus 14 are captured in the downstream nips 90 by which they are conveyed downstream for additional processing, such as into the sheet receiving bin 91 of the downstacker 15. The sheet feeding and slitting apparatus of the present invention provides a system for effectively processing fiberboard sheets which are of a size typically difficult to handle and to slit with the required accuracy.

We claim:

1. An apparatus for feeding sheets horizontally from the top of an ascending stack of sheets comprising:

a pair of parallel driveshafts mounted above the stack and extending normal to and spaced from one another in the direction of sheet feed;

two pairs of sheet feeding rake arms suspended from said driveshafts by a linkage mechanism for alternating reciprocal movement over the top of the stack between an upstream position and a downstream position in the direction of sheet feed;

said linkage mechanism including a drive arm for each of the rake arms, each drive arm having an upper end fixedly attached to one driveshaft and a lower end rotatably attached to the rake arm, and a support arm having an upper end rotatably attached to the other driveshaft and a lower end rotatably attached to the rake arm, one pair of rake arms having its drive arms attached to one driveshaft and the other pair of rake arms having its drive arms attached to the other driveshaft;

means for independently and reversibly driving each driveshaft to cause alternating reciprocal movement of said one pair of rake arms with respect to the other pair of rake arms; and, a rake head attached to the upstream end of each rake arm such that the rake heads of one commonly attached pair of rake arms in the upstream position engage the upstream edge of the top sheet while the rake heads of the other pair of rake arms are in the downstream position.

2. The apparatus as set forth in claim 1 wherein each of said rake arms comprises a flexible resilient member positioned to bias the rake head against the surface of the sheet.

3. The apparatus as set forth in claim 2 wherein each of said rake arms comprising a thin flexible strip and each rake head attached thereto comprises a rigid body having a sheet edge-engaging claw.

4. The apparatus as set forth in claim 3 including means for imparting a lateral flexibility to each rake arm for permitting the attached rake head to accommodate cross machine direction irregularities in said sheets.

5. The apparatus as set forth in claim 4 wherein said means for imparting flexibility comprises a series of longitudinally extending parallel slits in the portion of the rake arm adjacent the rake head.

6. The apparatus as set forth in claim 1 including means mounting the apparatus for adjustable positioning over the stack to position the apparatus for sheets of varying length.

7. The apparatus as set forth in claim 1 wherein each rake arm linkage forms a four bar parallelogram linkage.

8. The apparatus as set forth in claim 1 comprising gate means aligned with the top of the stack and positioned to allow a single sheet to be fed therefrom.

9. The apparatus as set forth in claim 8 wherein said gate means comprises a vertically movable backstop in engagement with the downstream edges of a plurality of sheets at the top of the stack, a horizontal shoe in downwardly biased contact with the top sheet of the stack directly above the backstop, and a rigid link interconnecting said backstop and said shoe to define and maintain a gate opening therebetween.

* * * * *